United States Patent [19]

Schieck

[11] Patent Number: 4,559,855

[45] Date of Patent: Dec. 24, 1985

[54] PLURAL MODE COPY SHEET OUTPUT SLITTER

[75] Inventor: Richard A. Schieck, Rochester, N.Y.

[73] Assignee: Xerox Corporation, Stamford, Conn.

[21] Appl. No.: 633,760

[22] Filed: Jul. 23, 1984

[51] Int. Cl.[4] ..... B26D 1/14

[52] U.S. Cl. ..... 83/425.3; 83/430; 83/482; 83/501; 83/553

[58] Field of Search ..... 83/430, 425.3, 425.4, 83/553, 479, 480, 482, 500–504

[56] References Cited

U.S. PATENT DOCUMENTS

| | | | |
|---|---|---|---|
| 614,809 | 11/1898 | Henkle . | |
| 827,577 | 7/1906 | Smith | 83/502 |
| 1,727,796 | 9/1929 | Sumner | 83/430 |
| 2,216,629 | 10/1940 | Sabel et al. . | |
| 3,105,425 | 10/1963 | Cerasani et al. | 95/1.7 |
| 3,185,007 | 5/1965 | Pine et al. | 83/482 X |
| 3,402,628 | 9/1968 | Redding et al. | 83/434 |
| 3,466,959 | 9/1969 | Wharton | 83/205 |
| 3,621,746 | 11/1971 | Womack | 83/430 |
| 3,788,180 | 1/1974 | Potsche et al. | 83/449 |
| 3,855,890 | 12/1974 | Lynch et al. | 83/331 |
| 3,941,473 | 3/1976 | Goffe | 355/75 |
| 3,971,279 | 7/1976 | Wright | 83/425.4 |
| 4,046,043 | 9/1977 | Kistner et al. | 83/425.4 |
| 4,224,850 | 9/1980 | Holmi et al. | 83/430 X |
| 4,228,735 | 10/1980 | Doucet | 101/227 |
| 4,436,409 | 3/1984 | Queener | 355/14 |

*Primary Examiner*—James M. Meister

[57] ABSTRACT

In a copier with a copy sheet output slitter for slitting the copy sheets outputted by the copier into a selected plural number of smaller sub-sheets cut in the direction of movement of the outputted copy sheets, and wherein the output slitter also optionally provides uncut copy sheet output, and provides a transport path for both cut and uncut copy sheet output, the improvement wherein the output slitter comprises a plurality of first generally cylindrical metal rollers rotatably driven on a first shaft and a second plurality of generally cylindrical metal rollers on a second shaft parallel to and spaced from the first shaft, the spacing and the diameters of these rollers being such that the first rollers interdigitate the second rollers, the first and second rollers having sharpened opposing radial end surfaces selectively forming paper slitting shears therebetween by end-abutting selected ones, or none, of the first and second rollers by selective movement of rollers along the axis of at least one of the shafts relative to other rollers on the other shaft to selectively form a selected number of, or no, paper slitting shears in the output path of the copier to provide a selected number of, or no, cut sub-sheets. Spring-loading provides a preset and self-adjusting abutment force between end-abutting rollers sufficient to provide the selected paper slitting and also self-sharpening. The rollers also assist in the copy sheet output transport by non-cutting engagement of their generally cylindrical surfaces with the copy sheets, preferably assisted by opposing engaging resilient frictional wheels.

1 Claim, 4 Drawing Figures

PLURAL MODE COPY SHEET OUTPUT SLITTER

This invention relates to improved selective and variable copy sheet slitting apparatus for use in an automatic copying machine.

The copier field has expanded greatly, bringing with it more sophisticated and higher speed equipment, and expanded applications for equipment capable of performing many widely diverse or specialized copying and copy sheet handling tasks. In particular, there is a need for a simpler and more compact but longer life and lower maintainance sheet cutting mechanism which, upon demand, can slit a copy sheet into a selected plural number of sub-sheets or, alternatively, permit the copy sheet to exit the machine uncut, which sheet cutting apparatus can be easily and inexpensively incorporated into existing copying devices and operated with a minimum of operator involvement or skill or adjustments.

Existing cutting devices for cutting a copy sheet into plural sheets in its direction of movement typically have thin rotary slitter blades or knives at or adjacent to the copier output that are mounted in abutting relation with a cooperating blade backing member. Conventionally, in this type of cutting device the blade is accurately and critically pre-positioned very closely, or directly contacting, perpendicularly, an underlying backing roller. In this arrangement, the allowable working tolerance between these two co-acting overlying elements is extremely small. A dulling of the blade, due to excessive pressure, will result if the blade is placed too closely to a hard backing member. On the other hand, miss-cuts are experienced when the blade is positioned too far out of contact with the backing member. A modification which alleviates some of those difficulties is disclosed in U.S. Pat. Nos. 3,402,628 and 3,855,890. Here, the thin rotatable cutting blades are mounted at the output of a copier, extending into the path of movement of a copy sheet to be acted upon. Each thin blade is spring-biased into contact with a directly opposing (underlying) rotating backing roller constructed of an elastomeric material, and the blade is caused to turn with the roller. In operation, the backing roller is rotated in the direction of sheet travel and the copy sheet is passed between the blade and the backing roller to produce a more uniform cut. Because of the arrangement of the cutting blade and the backing roller, the wear upon the cutting blade is reduced, but not eliminated, and additionally it has been found that the urethane or other elastomer backing roller becomes worn or cut after repeated use, forming a groove therein under the roller blade, thus losing its effectiveness.

Other examples of copy sheet cutters, for the output of a xerographic or other copiers, are disclosed in U.S. Pat. Nos. 2,216,629; 3,105,425 and 3,971,279.

Examples of other slitters or cutters are in U.S. Pat. Nos. 614,809; 3,466,959; 3,788,180; 4,046,043 and 4,228,735.

It is possible that metal sheets may have been sheared with cylinders somewhat similar to those disclosed herein, but no specific or citable art is known to the inventor or his attorney.

A particular application and utility of copy sheet output cutters or slitters for copiers is described in the second paragraph of the above-cited U.S. Pat. No. 3,402,628, issued Sept. 24, 1968 to Redding et al. As stated there, ". . . when producing multiple copies from a master one-half the size of the copy sheet, two masters placed side-by-side may be exposed simultaneously and the copy sheet slit in halves to produce twice the number of copiers than if only a single master was utilized." I.e., effectively doubling the copy output rate.

U.S. pending application Ser. No. 541,612 filed Oct. 13, 1983 by T. Acquaviva generally discusses at the third paragraph from the end of its specification output cutting applications, including binding of the cut-up copy sheets into forms or pads.

As stated in the Xerox Disclosure Bulletin Vol. 8, No. 2, p. 121, published Mar./Apr. 1983, frequently an electrophotographic copying machine using a flash illumination system cannot reproduce or copy an original document which is 11 inches by 17 inches, onto an 11 inch by 17 inch sheet of copy paper because of the size limitations of both the photoreceptor belt width and the available lengthwise (platen) imaging area. In order to achieve this, the 11 inch by 17 inch original document is advanced, short edge forward, to the registration edge on the platen of the machine. The optical system is flashed at times such that the first flash occurs when the first half of the document, i.e. 8½ inches by 11 inches, is exactly in the image area on the photoreceptor belt. The second flash occurs when the second half of the original document is in the identical position in the imaging area. The document transport, i.e. a recirculating document handler, moves at substantially the same speed as the photoconductive belt. The machine logic insures that the timing for the flash illumination of each half of the original document is in synchronism with belt movement.

Such useful applications for an improved output cutter or slitter also include the cutting up of plural optically reduced image size copies made on a single copy sheet from plural documents in a copier providing optical reductions. Further noted re the latter is IBM European patent application publication No. 0,082,939 of June 7, 1983 based on U.S. Ser. No. 335,932 filed Dec. 30, 1981.

The present invention is particularly suited for integral combination into a copier also having a document feeder adapted for simultaneously or sequentially feeding plural documents to the platen of a copier, for cutting the copy sheets integrally bearing these plural document images (which may also include additional "forms overlay" images from an apertured or partially transparent form on the platen) into an equal number of sub-sheets at the copier output, each sub-sheet being a now-separate copy of one of the plural documents. This allows standard size copy paper, even heavy card stock suitable for postcards, to be normally loaded into the copier and internally processed normally as normal size copy sheets, even though the output sheets are much smaller. Thus postcards or other small copies can be produced with both increased reliability and greatly increased effective document copying and copy producing rates without requiring a higher speed copier. Such a specific application is further described in a commonly pending application Ser. No. 633,736 by the same inventor and assignee being published as a SIR.

Copy output cutters or slitters cut the copy output in its direction of output movement, i.e. continuously cut the output into plural narrower width sub-sheets. In contrast, copy sheet "choppers" cut an elongate copy web or sheet transversely to its direction of movement into sheets and therefore differ substantially in requisite structure and function. For example, temporary interruption of the web movement is normally required for choppers. Choppers operate to decrease the output sheet length (but not width) by more frequently (rapidly) operating the chopper to increase the number of cuts. In contrast, slitters require more slitting locations to increase the number of slits. Examples of copy output choopers are disclosed, for example, in U.S. Pat. No. 3,882,744 issued May 13, 1975 to Alan F. McCarroll and other art cited therein.

Unlike the typical prior art cutting systems disclosed in the above references, in the present system the cutting edges are not in pressure contact or critical perpendicular opposition to a backing member. Instead, they overlap, and are freely slidable relative to another, parallel, cutting surface, with uncritical spacing therebetween, and without the above-described problems of dulling or wear. Cutting is by a (more positive) shearing action. Also, the number of slits is readily changed.

The present cutting system is usable with almost any copier, and is particularly suitable for becoming an integral part of a xerographic copier by direct substitution (replacement) for the existing copy sheet exit or ejection rollers and their shafts present in almost all copiers. It does not require any new or separate frames, mountings, drives, motors or the like. To that end, the present system has a particularly low cutting normal force and torque, and therefore does not require heavy shafts or supports or drives or a critical spacing or adjustment therefor.

The copier disclosed herein in FIG. 1, by way of one example, is otherwise conventional and corresponds to the Xerox Corporation "1075" copier. Only the copy sheet output is modified. It is shown with one example of a modification thereof to incorporate an example of the present invention. Further details of this exemplary copier and its document recirculating apparatus per se are disclosed in U.S. Pat. No. 4,278,344 issued July 14, 1981 to Ravi B. Sahay. Further details of controls for this exemplary copier are disclosed in the following pending U.S. patent applications and foreign equivalents thereof: Ser. Nos. 420,965; 420,993 and 421,006, all filed Sept. 21, 1982.

Examples of various other patents generally teaching known document handlers and copiers and control systems therefor, including document and paper path switches and counters, are U.S. Pat. Nos.: 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270 and 4,335,949. Conventional simple software instructions in a copier's conventional microprocessor logic circuitry and software of document handler and copier control functions and logic, as taught by the above and other patents and various commercial copiers, are well known and preferred. However, it will be appreciated that the functions and controls described herein may be alternatively conventionally incorporated into a copier utilizing any other suitable or known simple software or hard wired logic systems, switch controllers, etc. Suitable software for functions illustrated or described herein may vary depending on the particular microprocessor or microcomputer system utilized, of course, but will be already available to or readily programmable by those skilled in the art without experimentation from the descriptions and references provided herein.

The control of exemplary document and copy sheet handling systems may be accomplished by conventionally actuating them by signals from the controller directly or indirectly in response to simple programmed commands and from selected actuation or non-actuation of conventional copier switch inputs by the copier operator, such as switches selecting the number of copies to be made in that run, selecting simplex or duplex copying, selecting whether the documents are simplex or duplex, selecting a copy sheet supply tray, etc. The resultant controller signals may conventionally actuate various conventional electrical solenoid or cam controlled sheet deflector fingers, motors or clutches in the copier in the selected steps or sequences as programmed. Conventional sheet path sensors, switches and bail bars, connected to the controller, may be utilized for sensing and timing the positions of documents and copy sheets, as is well known in the art, and taught in the above and other patents and products. Copying systems utilize such conventional microprocessor control circuitry with such connecting switches and sensors for counting and comparing the numbers of document and copy sheets as they are fed and circulated, keeping track of their positions, counting the number of completed document set circulations and completed copies, etc. and thereby controlling the operation of the document and copy sheet feeders and inverters, etc.

All references cited herein, and their references, are incorporated by reference herein for appropriate teachings of additional or alternative details, features, and/or technical background.

The present invention desirably overcomes or reduces various of the problems or limitations discussed above and/or in the cited references.

A preferred specific feature disclosed in this specification is to provide, in a copier with a copy sheet output slitter for slitting the copy sheets outputted by the copier into a selected plural number of smaller subsheets cut in the direction of movement of the outputted copy sheets, and wherein said output slitter also optionally provides uncut copy sheet output, and provides a transport path for both cut and uncut copy sheet output; the improvement wherein said output slitter comprises a plurality of first generally cylindrical metal rollers rotatably driven on a first shaft and a second plurality of generally cylindrical metal rollers on a second shaft parallel to and spaced from said first shaft, said spacing and the diameters of said rollers being such that said first rollers interdigitate said second rollers, said first and second rollers having sharpened opposing radial end surfaces adapted to directly rotatably end-abut one another to form paper slitting shears between end-abutting first and second rollers, and means for selectively end-abutting selected ones, or none, of said first and second rollers by selective movement of rollers along the axis of at least one of said first or second shafts relative to other rollers on the other said shaft to selectively form a selected number of, or no, paper slitting shears in the output path of the copier to provide a selected number of, or no, cut sub-sheets, and wherein said rollers also assist in said copy sheet output transport by non-cutting engagement of the generally cylindrical surfaces of said rollers with said copy sheets.

Additional specific features disclosed herein are such as wherein at least one of said first and second shafts also has rotatably driven deformable resilient frictional sheet feeding members cooperating with said rollers for said copy sheet output transport; and wherein spring-loading means provides a preset and self-adjusting abutment force between said end-abutting rollers sufficient to provide said selected paper slitting and also self-sharpening thereof by said rotational abutment therebetween.

Various of the above-mentioned and further features and advantages will be apparent from the example described hereinbelow of one specific apparatus and its operation. The invention will be better understood by reference to the following description of this one specific embodiment thereof, which includes the following drawing figures (approximately to scale) wherein.

Figure 1:
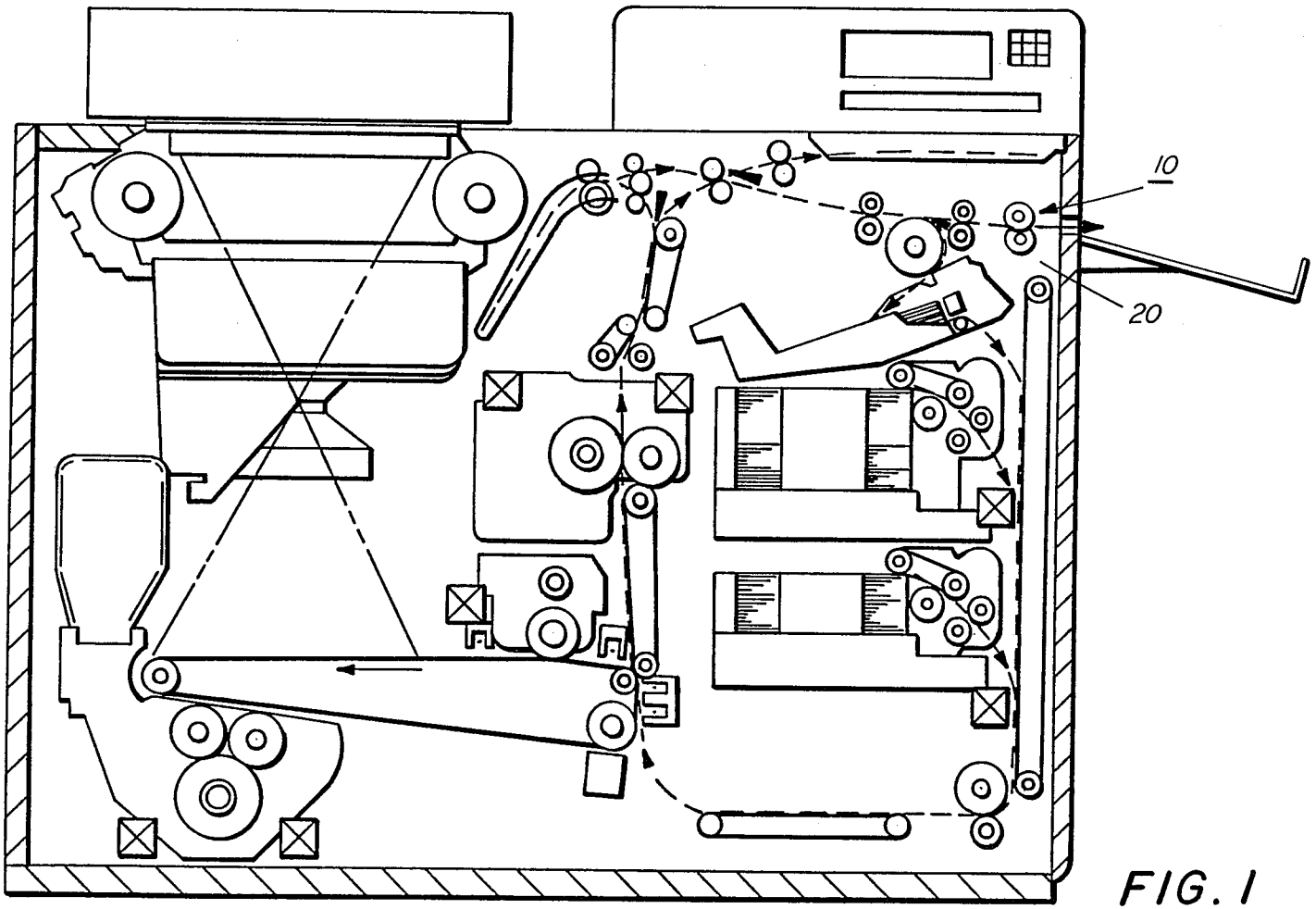
FIG. 1 is a side view of an exemplary copier with a schematic exemplary recirculating document handler thereon, showing a modification of the output for copy sheets thereof in accordance with one example of the present invention.
Figure 2:
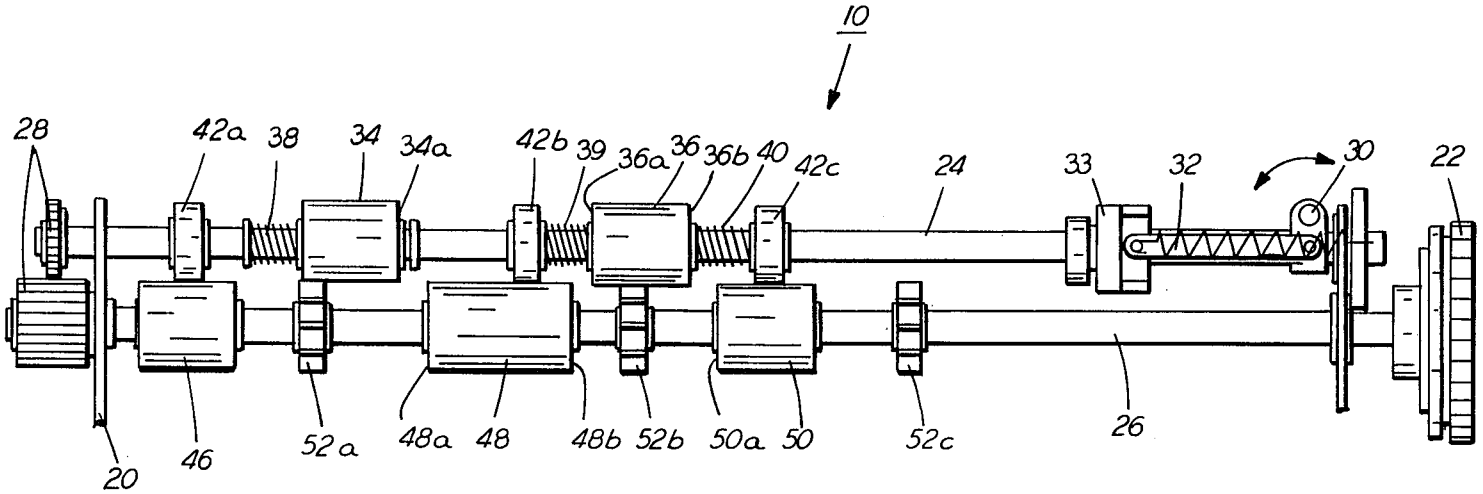
FIG. 2 is a frontal view of the exemplary copy sheet output slitter of FIG. 1, showing its non-cutting position for transporting of uncut copy sheet output.
Figure 3:
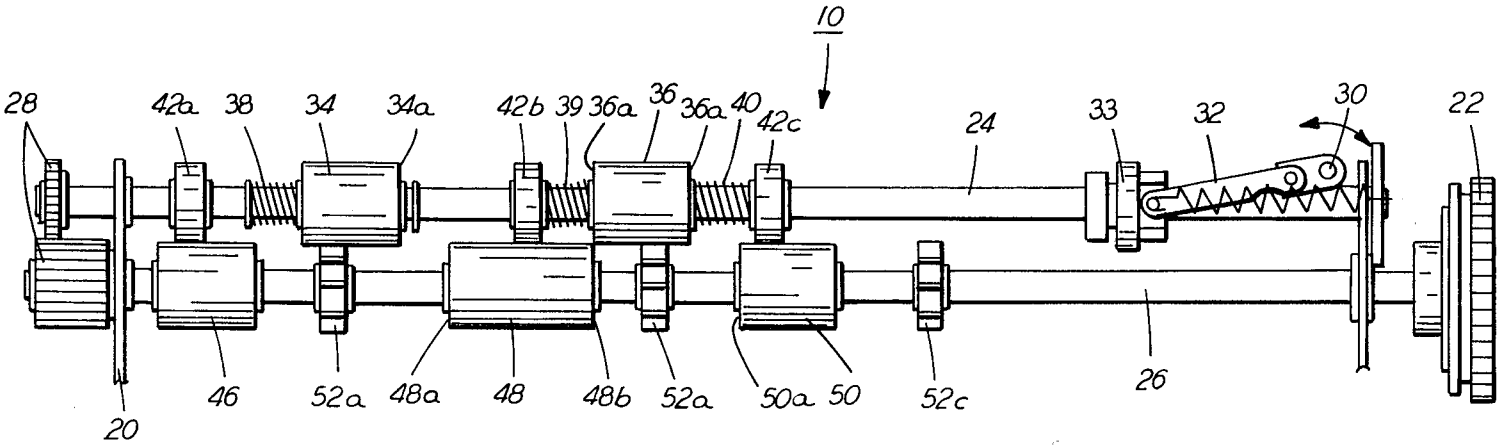
FIG. 3 is the same view as FIG. 2 but with said slitter actuated in a second position for making a single cut (two sub-sheets) of each outputted copy sheet.
Figure 4:
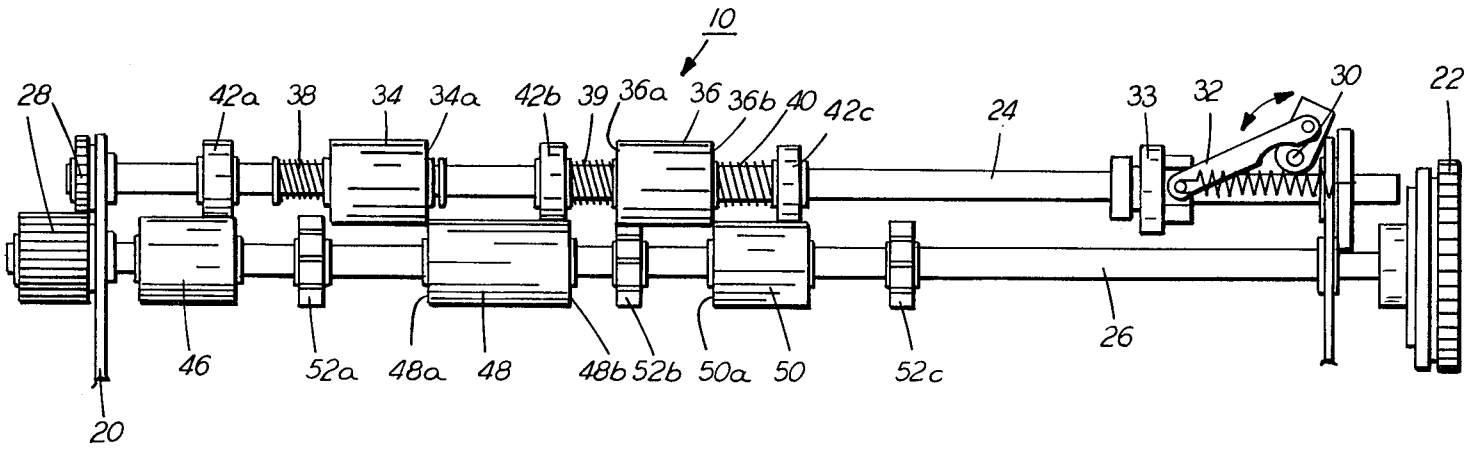
FIG. 4 is the same view as FIGS. 2 and 3 with said same copy sheet output slitter moved into a third position in which it shears each copy sheet in two different positions (into 3 sub-sheets).

As shown in FIG. 1, the exemplary copy sheet slitting apparatus 10 disclosed herein may be positioned at the copy sheet output of any suitable or conventional copier 20. The exemplary copier 20 illustrated here is further described in the references thereon cited hereinabove. Preferably the copy sheet slitting apparatus 10 herein is a direct replacement for the conventional existing output shafts and feed rollers of such a copier. That is, the two existing parallel shafts and rollers thereon are removed and the apparatus 10 is installed directly in its place. The apparatus 10 is also preferably adapted to be driven by the same motors and gear or chain drives as the existing output rollers. It is specifically adapted to operate at low power and low torque so as not to require a special or separate drive. The exemplary drive gear 22 shown in FIGS. 2–4 is thus adapted to mate with and be driven by the existing drive in a copier for that gear, at the existing drive speed, and to provide the appropriate copy sheet output speed for that copier. The copy sheet slitting apparatus 10, as fully further described herein, does not interfere in any way with the normal output of copy sheets. In fact, it provides positive transport of copy sheets, with comparable or even better copy sheet transporting than the existing non-cutting output feed wheels of a copier.

The two replacement shafts for the existing output roller shafts illustrated here may be labeled an upper shaft 24 and a lower shaft 26. The spacing therebetween is the same as for the conventional exit roller shafts. At least one of these two shafts, here the lower shaft 26, is adapted to be driven from the copier, here by the drive gear 22. A further gear set 28 preferably connects between the two shafts 24 and 26 to drive both at the same rotational velocity. This provides a more positive feeding and cutting. However, it is not essential. One of the shafts and/or some of the wheels thereon may be idlers, i.e. freely rotatable and driven solely by engagement with opposing frictional rollers.

Note that the gear set 28 is adapted to allow axial movement of the upper shaft 24 and all of the parts thereon, while the lower shaft 28 is axially fixed. This axial repositioning of the upper shaft 24 is by means of a crank 30 and connecting arm 32, the end of which pushes against a collar 33 on the shaft 24. Rotation of the crank 30 into one of the three positions respectively illustrated in FIGS. 2, 3, and 4 (or use of other suitable mechanical positioner) corresponding moves the upper shaft 24 into the respective positions shown. These three selected positions respectively provide for no cutting of the copy sheet as in FIG. 2, one cut of the copy sheet as in FIG. 3 or two cuts of the copy sheet as in FIG. 4. In all three cases the copy sheet is ejected from the copier between the upper shaft 24 and the lower shaft 26 (and directly toward the observer in FIGS. 2–4) into a suitable catch tray, sorter or finisher.

The upper shaft 24 has two generally cylindrical metal cutting cylinders 34 and 36 slidably spaced along the upper shaft 24 and slidably attached thereto for concentric rotation. These cutting cylinders 34 and 36 are acted upon by one end of coil springs 38, 39 and 40 also on the upper shaft 24. The opposite ends of these same springs 38, 39 and 40 are restrained from axial movement relative to the upper shaft 24 by suitable end stops, such as snap rings or the like retained in grooves on the shaft 24. Axial movement of the upper shaft 24 via the crank 30 and arm 32 generally correspondingly moves the cutting cylinders 34 and 36 axially, but indirectly via the springs 38, 39 and 40, with independent movement freedom. That is, the cutting cylinders 34 and 36 are axially self-adjusting in position with a preset spring force, as will be further described herein.

The upper shaft 24 also includes three conventional frictional sheet feeding rollers, 42*a*, 42*b* and 42*c*. These may be of conventional foraminous or otherwise resilient material such as urethane or other suitable deformable material which will not affect the copy sheet other than to provide positive engagement and feeding thereof.

Turning now to the lower shaft 26, it will be appreciated that while it is described as the lower shaft here, that the two shafts 26 and 24 could be reversed in structure, function or position. Here the lower shaft 26 has a non-cutting cylinder 46 (which could be used to provide an additional cutting position if desired) and two generally cylindrical metal cutting cylinders 48 and 50. The cutting cylinder 48 is substantially longer than the other cutting cylinders herein, and also is adapted to cut at either end thereof, as will be further described herein.

Also optionally mounted on the lower shaft 26, spaced therealong, for driving rotation therewith, are three conventional exit flapper assists 52*a*, 52*b* and 52*c*. They provide additional frictional sheet jogging and feeding and end flipping ejection copy sheets in areas with no opposing cylinder or roller.

It will be noted that the elastomeric frictional feeding rollers 42*a*, *b*, and *c* are adapted and positioned to deformably engage and provide a sheet feeding nip with, respectively, the cylinders 46, 48 and 50 on the opposing lower shaft 26, irrespective of which of the three axial positions of the upper shaft 24 it is in. That is, the feed rollers 42*a*, *b* and *c*, freely slide along the smooth metal cylindrical surfaces of their opposing metal cylinders 46, 48 and 50, parallel thereto, during the repositioning of the upper shaft 24, but always remain in engagement therewith.

In the present system, unlike various of the above-cited references, the cutting of the output copy sheet is not provided by thin rotary knives or slitters, nor is there any normal or pressure engagement with a backup roller. Rather, in the present system, cutting of the copy sheets is provided by paper slitting shears formed by the overlapping edges of engaged end surfaces, specifically sharpened radial end surfaces 34*a*, 36*a*, 36*b*, 48*a*, 48*b*, and 50*a* on the respective ends of the above-indicated respective cutting cylinders.

In the position of FIG. 2 of the upper shaft 24 none of these end surfaces are engaging and therefore there is no cutting of the paper. In the position of FIG. 3 only the end surfaces 36*a* and 48*b* are engaged, to provide a single cutting shear. In the position of FIG. 4, surface 34*b* mates with surface 48*a*, and also end surfaces 36*b* and 50*a* are mating, to provide two separate shears.

It may be seen that with the spacing between the two shafts 24 and 26, and the fact that opposing radii of the cutting cylinders on one shaft relative to the cutting cylinders on the other shaft are greater than this shaft spacing, that there is an overlap in the cutting cylinders. That is, the diameters of the cutting cylinders are slightly larger than the distance between the centers of the respective upper and lower shafts. Thus the cutting cylinders on opposing shafts are interdigitated relative to one another. This allows the end surfaces 34*a*, 36*a* and 36*b* on the upper shaft 24 to radially overlap, so that they may partially engage at their outer areas with the opposite end surfaces 48*a*, 48*b* and 50*a* on the cutting cylinders of the lower shaft 26. The amount of this overlap provided by shaft spacing and cutting cylinder diameters is not critical. There need only be sufficient minimum overlap to provide a positive shearing or scissors affect on the copy sheet. It has been determined that a smaller overlap (less radial interference) e.g. approximately less than one mm for a 26 mm roller, allows the cutting cylinder to provide self-feeding (draw the sheet in).

In this system, no cutting is done by the generally cylindrical body of the cutting rollers. In fact in this system the body of the rollers, provided by their generally cylindrical outer surface, provides a slight corrugating and copy sheet transporting surface which does not affect the copy sheet other than to assist in its transport. Cutting is done only at end corners by the slightly overlapping abutment of the end surfaces of the cylinders. The cutting cylinders thus directly cooperate with the other feed rollers 42*a*, *b* and *c* for positive sheet feeding. The shearing or cutting areas also provide feeding forces for the copy sheet in the same direction. Thus the cutting does not provide any resistance to the normal movement of the copy sheet and in fact, assists it.

As described above, this cutting end abutment is not critical, because the spring loading provided by springs 38, 39 and 40 provides a preset and self-adjusting abutment force sufficient to provide the paper slitting, if any, for that selected position of the upper shaft 24. This spring force need only be sufficient to insure continued close rotational abutment in that selected shaft position even during cutting, which tends to separate the cutting rollers. There is also preferably a sufficient abutment force so that the respective abutting end surfaces rub against each other with sufficient force to be self-sharpening, i.e. intentionally providing a slight wearing engagement of the surfaces, by the non-concentric rotational abutment therebetween. An approximately five ounce (1.4 Newton) abutment force has been found satisfactory.

Preferably the above-described radial and cutting faces of the cutting cylinders are "square ground", to insure sharp corners or edges at the cylinder ends and planar and true perpendicular end surfaces for flat and even engagement.

Summarizing the above operation, the exemplary copy sheet slitting apparatus 10 shown here has three operating modes. It will be appreciated that additional operating modes may be provided for additional numbers of cuts of the copy sheet or different cut positions in the same manner, e.g. by adding or repositioning cutting cylinders or changing their lengths. All the modes are provided by simple axial movement of one of the two shafts, here the upper shaft 24. A mode may be selected simply by an external operator set 3-position knob directly fastened to the rotatable shaft of the crank 30. Alternatively, shaft movements may be made automatically in response to a signal from the copier controller to a motor or solenoid shaft repositioner, e.g. automatically in response to the number of document images placed on the copy sheet to be cut.

When the upper shaft 24 is so moved to its furthest leftmost position, as shown in FIG. 3, the exiting copy sheets are only slit intermediately. Here, $8\frac{1}{2}\times 11$ inch sheets (U.S. letter-size) are cut in half in their direction of motion. This cutting position is of course, presettable and adjustable merely by changing the axial mounting positions of the cutting cylinders on their respective shafts. Here the end surface 48*b* is fixed in a preset position and the opposing cutting surface 36*a* is pressed thereagainst by spring 40 to define the cutting position.

When the upper shaft 24 is moved one position to the right relative to the above position, as is shown in FIG. 2, the above cutting surfaces are removed from engagement and no other cutting surfaces are in engagement. Thus, in this position copy sheets are positively transported and ejected without any cutting or damage as if no cutter were present.

When the upper shaft 24 is moved all the way to its furthest right position as in FIG. 4, spring 39 now presses end surface 36*b* against opposing fixed position end surface 50*a* to define one cutting or shearing position, and meanwhile simultaneously spring 38 pushes the end 34*a* of cylinder 36 into abutment with end 48*a* of cutting cylinder 48, to define a second, separate, cutting or shearing position. Thus, all the exiting copy sheets are slit in two places. In this example, a standard letter size sheet is cut into thirds, to provide three postcard size sheets.

While shown and described herein as purely cylindrical, it will be appreciated that the cutting cylinders may be of various other, generally cylindrical, shapes, such as barrel-shaped rollers, stepped dual diameter rollers, or the like, providing the appropriate mating cutting end surfaces and cutting edges are provided.

By "self-sharpening" above, it is not necessarily meant that the cutting surfaces actually sharpen themselves, although they may. (Here the cutting surfaces are the sharp end corners of the cutting cylinders, i.e. the circular line intersection of the end surfaces with the cylindrical surfaces of the cutting rollers.) Rather it is meant that wherever wear does occur at the end surfaces of the cutting cylinders due to mutual abutment and abrasives therebetween (which abrasives are present in certain copy papers and otherwise in the environment of the copier) that this wear will tend to maintain or even re-establish to some degree such a sharp corner.

Actual sharpening or resharpening with this system is very simple. The cutting cylinders are disengaged from their key, pin or other axially locking to their respective shafts and slid off of their shafts, conventionally end ground, and reinstalled. Alternatively, they may be easily replaced with new cutting cylinders simply by exchanging them or the entire shaft unit.

While the embodiment disclosed herein is preferred, it will be appreciated that it is merely one example, and that various alternatives, modifications, variations or improvements thereon may be made by those skilled in the art from this teaching, which is intended to be encompassed by the following claims:

What is claimed is:

1. In a copier with a copy sheet output slitter for slitting the copy sheets outputted by the copier into a plural number of smaller sub-sheets cut in the direction of movement of the outputted copy sheets, the improvement wherein said output slitter provides and replaces the normal uncut copy sheet output transport of said copier by providing a positively driven copy sheet output transport path for both said cut and uncut copy sheet output, wherein said output slitter comprises a plurality of first generally cylindrical metal rollers rotatably driven on a first shaft and a second plurality of generally cylindrical metal rollers on a second shaft parallel to and spaced from said first shaft, said spacing and the diameters of said rollers being such that said first rollers interdigitate said second rollers, said first and second rollers having sharpened opposing radial end surfaces adapted to be selectably rotatably end-abutted against one another to form paper slitting shears between end-abutting first and second rollers, and mode selector means for automatically selectively end-abutting either selected ones, or none, of said first and second rollers by selective axial repositioning movement of one of said first or second shafts and the rollers thereon relative to the other rollers on the other said shaft for selectively forming one, or a selected number of, or no, paper slitting positions in the output path of the copier for providing a selected number of, or no, cut sub-sheets, wherein at least one of said rollers is an axially elongated cylinder which end-abuts another roller at one end thereof in one said selected paper slitting position and end-abuts a different roller at the opposite end thereof in another said selected paper slitting position, and wherein said rollers also define portions of said copy sheet output transport by non-cutting engagement of the generally cylindrical surfaces of said rollers with said copy sheets, and wherein at least one of said first and second shafts also has rotatably driven deformable resilient frictional sheet feeding members positioned for non-cutting combination with said rollers, spaced from said end surfaces of said rollers, for providing said positive copy sheet output transport even for uncut flimsy paper sheets, of which at least one of said resilient frictional sheet feeding members is maintained in continuous sheet feeding nip engagement with only said cylindrical surface of at least one of said rollers in all said paper slitting or non-slitting positions of said mode selector means, and is axially repositionable along said cylindrical surface by said mode selector means, and wherein said mode selector means includes spring-loading means for automatically providing a preset and self-adjusting abutment force between said end-abutting rollers sufficient to maintain said selected paper slitting by said rotational abutment therebetween yet provide for uncritical axial repositioning of said rollers between modes by said mode selector means.

* * * * *